US007806512B2

(12) United States Patent
Yamamoto et al.

(10) Patent No.: US 7,806,512 B2
(45) Date of Patent: Oct. 5, 2010

(54) INK JET PRINTING APPARATUS AND INK JET PRINTING METHOD

(75) Inventors: Wakako Yamamoto, Sagamihara (JP); Hidehiko Kanda, Yokohama (JP); Hirokazu Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 12/241,652

(22) Filed: Sep. 30, 2008

(65) Prior Publication Data

US 2009/0091599 A1 Apr. 9, 2009

(30) Foreign Application Priority Data

Oct. 4, 2007 (JP) ..... 2007-261264

(51) Int. Cl.
*B41J 2/21* (2006.01)

(52) U.S. Cl. ..... 347/43; 347/40

(58) Field of Classification Search ..... 347/40–43, 347/20, 9, 12
See application file for complete search history.

(56) References Cited

U.S. PATENT DOCUMENTS 6,682,168 B2 1/2004 Nakagawa et al.
6,688,716 B2 2/2004 Kanda et al.
2004/0252160 A1 12/2004 Iwasaki et al.

FOREIGN PATENT DOCUMENTS

JP 2001-171151 A 6/2001
JP 2005-1336 A 1/2005

*Primary Examiner*—Thinh H Nguyen
(74) *Attorney, Agent, or Firm*—Fitzpatrick, Cella, Harper & Scinto

(57) ABSTRACT

The order of the arrangement of ejection opening arrays of two types of ink overlapping in reciprocating scan is decided as follows. An ejection order is decided so that the case where the fixing areas of a main droplet and a satellite are different (dot area is increased) in the forward and backward scan first occurs. By this configuration, the area of the dot and the portion in which different colors are generated due to the difference in the overlapping order in the reciprocating scan can be reduced, compared with the case where the arrangement order is opposite to the above-described case. As a result, a difference in color between areas for which printing is completed by the reciprocating scanning is reduced and thus color unevenness of a printed image can be reduced.

11 Claims, 19 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method, and specifically to reducing color unevenness which occurs when printing is performed by a bidirectional reciprocating scanning operation.

2. Description of the Related Art

Recently, office automation equipments such as personal computers or word processors come into wide use, and various printing apparatuses such as printers for outputting information prepared by the OA equipments are provided. Among the printing apparatuses, a serial type ink jet printing apparatus that executes scanning (scan) of an ink jet print head so as to perform printing is widely used as a printing apparatus capable of perform printing of a high quality and a high speed with relatively low cost.

In such a serial type printing apparatus, bidirectional printing is known as one of high-speed printing techniques. In the bidirectional printing, printing is performed by a forward scanning operation and a backward scanning operation of the print head. The bidirectional printing is performed by a method of completing the printing by a one-time reciprocating scanning operation or a method of completing the printing by a plural-time reciprocating scanning operation. The latter method is called a multi-pass printing method.

In the multi-pass printing method, a unit area for which printing is completed by plural-times of scan is printed with different nozzles in each of the plural-times of scan. More specifically, the nozzles of a print head is divided into a plurality of groups and a printing medium is conveyed by an amount corresponding to one group in each scan so that the plural-times of scan with which different nozzle groups are sequentially associated are performed. According to this printing method, unevenness in an ejection amount or an ejection direction of each nozzle can be dispersed into the plural-times scan and thus density unevenness due to the unevenness in the ejection amount or the ejection direction becomes not conspicuous.

As described above, according to the bidirectional printing, it is possible to obtain a printing speed which is twice as high as that of unidirectional printing for performing printing with a scanning operation of one-direction. In addition, it is possible to perform high-speed and high-quality printing by performing the multi-pass printing together.

However, in the bidirectional printing, it is also known that color unevenness or density unevenness due to an ejection order of respective color inks may occur.

FIGS. 1A to 1C are views illustrating the color unevenness due to the bidirectional printing, which shows a state in which cyan ink and magenta ink ejected from a print head respectively lands on a printing medium. A dot 3501 shown in FIG. 1A is a dot which is formed on the printing medium with the magenta ink ejected previously in a forward scan and a dot 3502 shown in FIG. 1B is a dot which is formed on the printing medium with the cyan ink ejected after the magenta ink in the same forward scan. That is, the print head or ejection opening (nozzle) arrays for ejecting the magenta ink and the print head or ejection opening arrays for ejecting the cyan ink are arranged in this order in the forward direction. In this case, in the forward scan, the magenta ink is first ejected and the cyan ink is then ejected. The respective dots formed with these inks have the same area (fixing area) when these dots do not overlap with each other, like the dots 3501 and 3502. However, in a case where a blue dot is printed, these inks are ejected so as to overlap with each other and thus the fixing area of the formed dot may be different from that of a single dot.

FIG. 1C is a view showing a state in which the magenta ink is first ejected and the cyan ink is then ejected so as to print the dot while performing scanning of the print head in the forward direction which is a +X direction. In FIG. 1C, a reference numeral 3503 denotes a blue dot (main dot) in which the magenta ink which is previously ejected and the cyan ink which is subsequently ejected overlap with each other. In contrast, a reference numeral 3504 denotes a cyan portion formed in the periphery of the main dot by overlapping the subsequent cyan ink with the previous magenta ink. As described above, when the magenta and cyan inks are ejected in this order, a blue dot is formed by the magenta ink which is previously ejected and the cyan ink which is subsequently ejected and the portion formed by the subsequently ejected cyan ink alone is formed in the periphery of the blue dot. This phenomenon notably occurs when printing is performed using a dye ink with respect to a paper (a coated paper) in which a coating layer including a metal oxide such as alumina or silica is formed on a base material. More specifically, the magenta ink which is previously ejected first lands on the printing medium and is permeated into and fixed on a surface layer (the coating layer) of the printing medium. Meanwhile, a part of the cyan ink which is subsequently ejected is permeated into and fixed to the portion, to which the magenta ink is fixed, so as to form the blue dot and the remaining part of the cyan ink which cannot be permeated into the portion to which the magenta ink is fixed is permeated into and fixed to the periphery of the blue dot. In this way, when the dot is formed by ejecting inks of different colors so as to overlap with each other, the fixing area is spread and thus a difference in color occurs due to the overlapping order. In this example, when the magenta ink and the cyan ink are sequentially ejected in the +X-direction scanning, a blue color with a cyan tint is obtained. In contrast, when the cyan ink and the magenta ink are sequentially ejected in the −X-direction scanning, a blue color with a magenta tint is obtained.

As described above, when the bidirectional printing is performed, the difference in the color may occur due to inversion of the ejection order of the inks between the forward scan and the backward scan and thus color unevenness may occur in the whole printed image. For example, in the method of completing printing by each one-time of forward and backward scans, respective colors of whole areas completed by respective forward and backward scans are different from each other and thus the different colors alternately appear from scan area to scan area. Even in the multi-pass printing, density unevenness or color unevenness, in which the color alternately varies according to the unit areas, occurs depending on the number of times of scanning for completing printing of the unit area.

So called a symmetrical head is known as a configuration for solving the color unevenness due to the ink overlapping order of the reciprocating scanning operation (Japanese Patent Laid-Open No. 2001-171151 and Japanese Patent Laid-Open No. 2005-001336). In these documents, two ejection opening arrays or print heads for cyan and magenta colors for example are provided and these arrays or heads for each color are symmetrically arranged in a main scan direction. Then, the different ejection opening arrays or print heads of each of cyan and magenta are used in the forward and backward directions so that the overlapping orders of cyan and magenta inks in the forward direction and the backward direction become equal to each other.

However, in the above prior arts, since at least the two ejection opening arrays or print heads of symmetrical arrangement are provided for one color, there may be problems that the size of the print head is increased and thus the size of the apparatus and cost are increased. That is, the configuration of the symmetrical head can solve the difference in the overlapping order of the reciprocating scanning, but has an inherent problem that additional ejection opening arrays or print heads are required.

The present invention can reduce color unevenness due to the difference in the overlapping order without employing the additional configuration. More specifically, the present invention is made by focusing on a portion of different color generated according to a difference in the overlapping order of different color inks in a dot formed by overlapping the different color inks, to decrease or substantially remove a color difference between the portions of different colors and then reduces color unevenness of a whole image.

As described above referring to FIG. 1, when inks are ejected in an overlapping manner, the dot of the ink which is subsequently ejected is spread to be formed larger. The spread portion has a different color due to the difference in the overlapping order in the reciprocating scanning. In the example shown in FIG. 1, a portion of the dot 3504 excluding the dot 3503 denotes the portion having the different color due to the difference in the overlapping order in the reciprocating scanning.

SUMMARY OF THE INVENTION

The present invention is made by focusing on a portion of different color generated according to a difference in the overlapping order of different color inks in a dot formed by overlapping the different color inks, to decrease or substantially remove a color difference between the portions of different colors. That is, an object of the present invention is to provide an ink jet printing apparatus and a printing method, which are capable of reducing color unevenness of a printed image by decreasing or removing the color difference.

In the first aspect of the present invention, there is provided an ink jet printing apparatus that uses a print head having a first ejection opening array for ejecting a first color ink and a second ejection opening array for ejecting a second color ink, and ejects the first and second color inks in this order during a scanning of the print head in a first direction and ejects the second and first color inks in this order during a scanning of the print head in a second direction to perform printing on a printing medium, wherein in the scanning in the first direction, a fixing area of the first color ink is larger than a fixing area of the second color ink, and in the scanning in the second direction, a fixing area of the second color ink is larger than a fixing area of the first color ink.

In the second aspect of the present invention, there is provided an ink jet printing apparatus that performs scanning of a print head, in which first and second ejection opening arrays for ejecting a first color ink and third and fourth ejection opening arrays for ejecting a second color ink are arranged in a predetermined direction in this order, to a predetermined area of a printing medium a plurality of times so as to perform printing, wherein when performing printing by an odd number of times of the scanning to the predetermined area, only the first and fourth ejection opening arrays of the first, second, third and fourth opening arrays are used for performing printing, and when performing printing by an even number of times of the scanning to the predetermined area, the first, second, third and fourth opening arrays are used for performing printing.

In the third aspect of the present invention, there is provided an ink jet printing apparatus that uses a print head having a first ejection opening array for ejecting a first color ink and a second ejection opening array for ejecting a second color ink, and ejects the first and second color inks in this order during a scanning of the print head in a first direction and ejects the second and first color inks in this order during a scanning of the print head in a second direction to perform printing on a printing medium, wherein in the scanning in the first direction, an ejection amount of the first color ink is larger than an ejection amount of the second color ink, and in the scanning in the second direction, an ejection amount of the second color ink is larger than an ejection amount of the first color ink.

In the fourth aspect of the present invention, there is provided an ink jet printing method of using a print head having a first ejection opening array for ejecting a first color ink and a second ejection opening array for ejecting a second color ink, and ejecting the first and second color inks in this order during a scanning of the print head in a first direction and ejecting the second and first color inks in this order during a scanning of the print head in a second direction to perform printing on a printing medium, wherein in the scanning in the first direction, a fixing area of the first color ink is larger than a fixing area of the second color ink, and in the scanning in the second direction, a fixing area of the second color ink is larger than a fixing area of the first color ink.

In the fifth aspect of the present invention, there is provided an ink jet printing method of performing scanning of a print head, in which first and second ejection opening arrays for ejecting a first color ink and third and fourth ejection opening arrays for ejecting a second color ink are arranged in a predetermined direction in this order, to a predetermined area of a printing medium a plurality of times so as to perform printing, wherein when performing printing by an odd number of times of the scanning to the predetermined area, only the first and fourth ejection opening arrays of the first, second, third and fourth opening arrays are used for performing printing, and when performing printing by an even number of times of the scanning to the predetermined area, the first, second, third and fourth opening arrays are used for performing printing.

According to the above-described configuration, it is possible to reduce the area of a portion to have different colors between a forward and backward scans, correspondingly to a difference in the overlapping order of inks in the forward and backward scans. As a result, it is possible to reduce a difference in color between respective areas for which printing is performed in the forward and backward scans respectively and thus decrease color unevenness of a printed image.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings.

Figure 2:
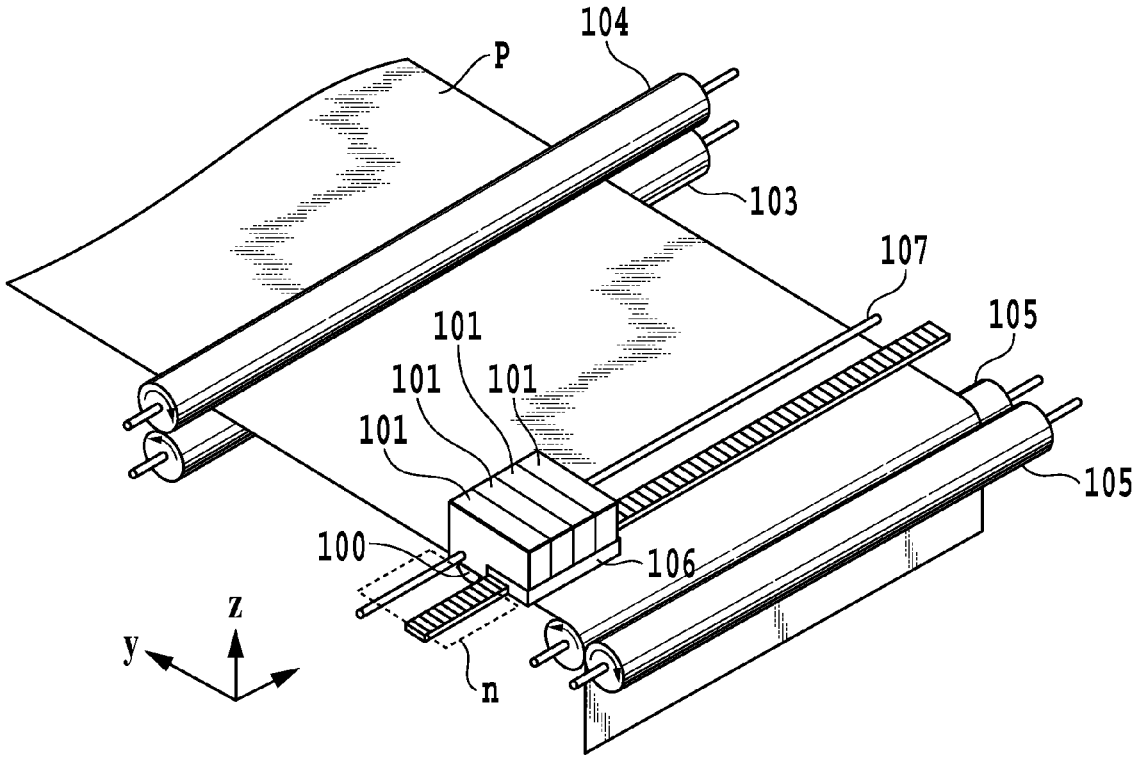
FIG. 2 is a schematic view of an ink jet printing apparatus according to an embodiment of the present invention.

FIG. 2 is a schematic view showing a serial type ink jet printing apparatus according to an embodiment of the present invention. In the serial type ink jet printing apparatus, a main scanning operation for ejecting an ink while a print head moves in a main scanning direction and a sub scanning operation for conveying a printing medium in a sub scanning direction intersecting the main scanning direction are repeatedly performed such that an image is printed on the printing medium.

In FIG. 2, a reference numeral 101 denotes ink cartridges. The ink cartridges 101 are ink containers which respectively store inks of cyan (C), magenta (M), yellow (Y) and black (Bk). A Reference numeral 100 denotes a print head in which arrays of a plurality of ejection openings (nozzles) for ejecting inks of four colors C, M, Y and Bk are integrally arranged. In more detail, in the print head 100, one ejection opening array in which a plurality (for example, 512) of ejection openings are arranged in the main scanning direction of the print head with respect to the inks of the four colors of C, M, Y and Bk. A reference numeral 106 denotes a carriage in which the ink cartridges 101 are detachably mounted and the print head 100 is integrally mounted. The carriage 106 may reciprocally move along a guide shaft 107, which is provided in parallel to the main scanning direction, by the driving force of a carriage motor.

A reference numeral 103 denotes a conveying roller which rotates by the driving force of a driving motor (not shown) The conveying roller 103 intermittently rotates by a reciprocating operation of the carriage 106 so as to convey a printing medium P in a conveying direction y by a predetermined amount while the printing medium P is inserted between the conveying roller and a subsidiary roller 104 which faces each other. A reference numeral 105 denotes a pair of feed rollers which feeds the printing medium P to the conveying roller 103. The pair of feed rollers 105 rotates while the printing medium P is inserted therebetween and conveys the printing medium P in the sub scanning direction (y direction) in corporation with the conveying roller 103 and the subsidiary roller 104.

The carriage 106 which stands by at a home position h at the time of non-printing moves in an X direction so as to perform the scanning operation of the print head 100 when a printing start command is input. During scanning, the inks of respective colors are ejected from the plurality of ejection openings of the respective colors of the print head so as to perform printing. When a printing operation based on printing data of one scan operation is completed, the carriage 106 returns to the home position and the printing medium P is conveyed by a predetermined amount. Then, the carriage moves in the X direction again so as to perform the scanning operation of the print head. By repeating the above-described operation, the printing can be performed with respect to the whole printing medium.

Figure 3:
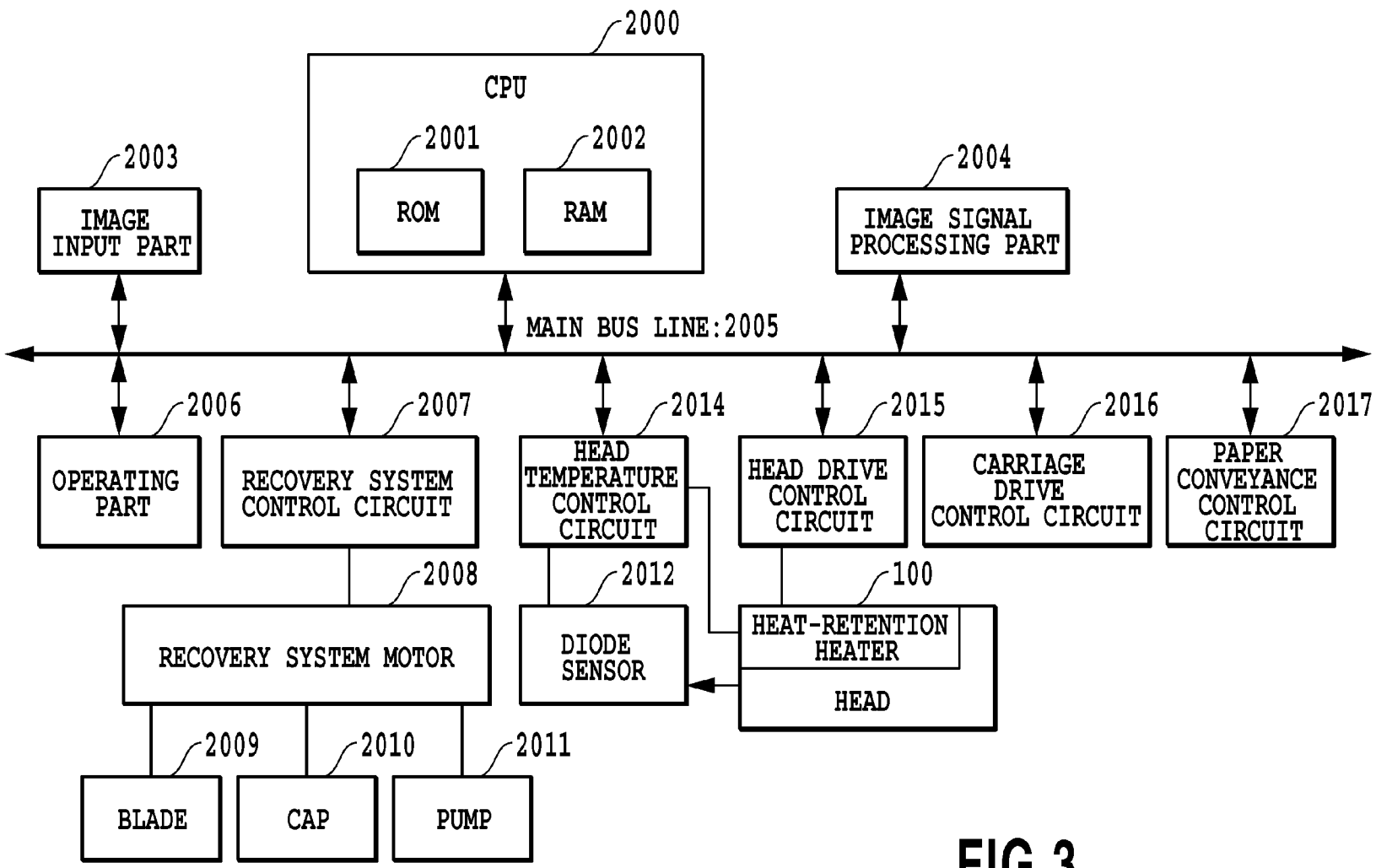
FIG. 3 is a block diagram showing a general configuration of a control system of the ink jet printing apparatus according to the embodiment of the present invention.

FIG. 3 is a block diagram showing a general configuration of a control system of the ink jet printing apparatus shown in FIG. 2. In FIG. 2, a main bus line 2005 is connected with a software system processing unit such as an image input part 2003, an image signal processing part 2004 and a central processing unit (CPU) 2000. The main bus line 2005 is connected with a hardware processing unit such as a operating part 2006, a recovery system control circuit 2007, a head temperature control circuit 2014, a head drive control circuit 2015, a carriage drive control circuit 2016, and a printing medium conveyance control circuit 2017.

Figure 12:
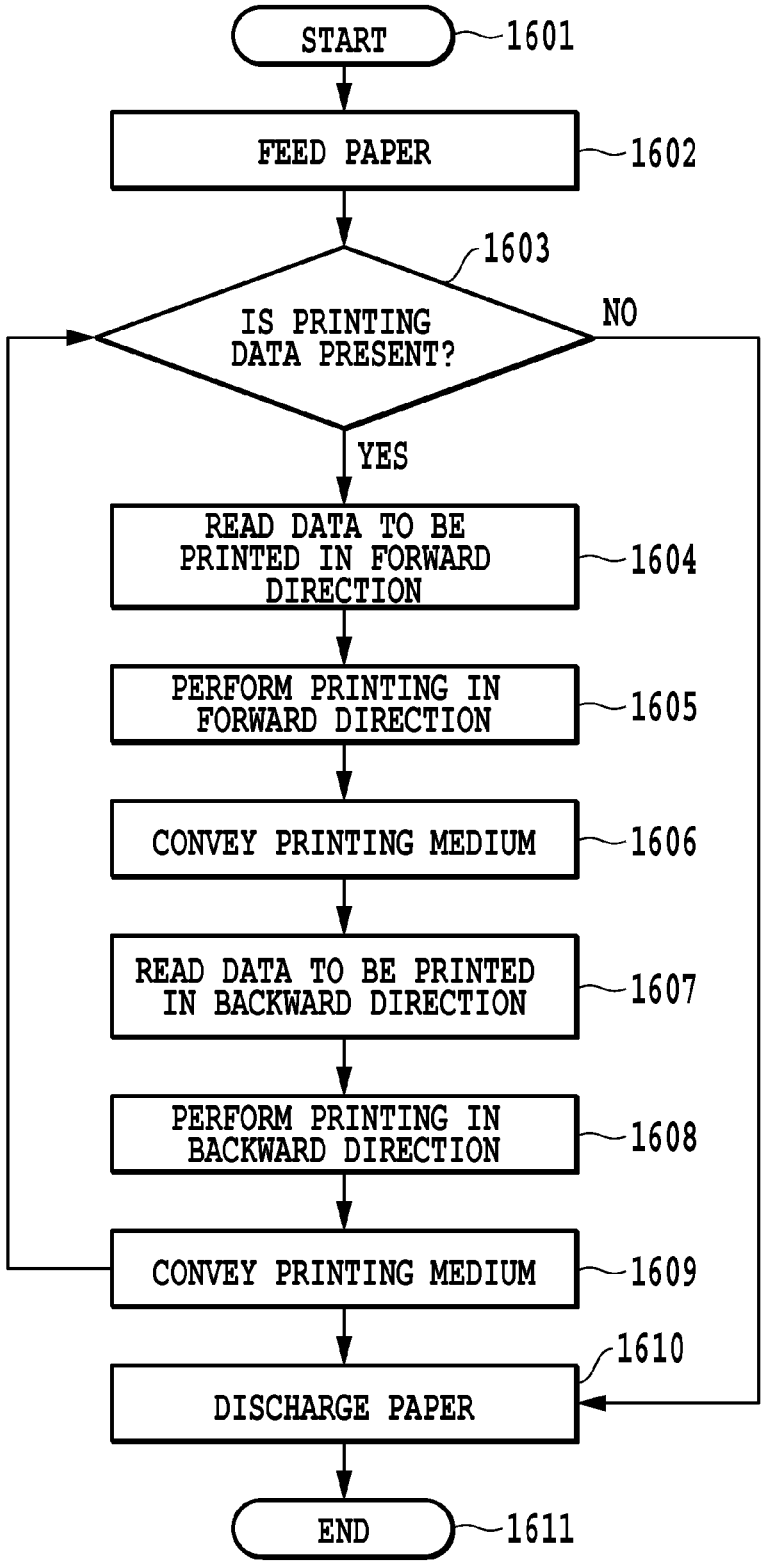
FIG. 12 is a flowchart showing a printing operation according to the first embodiment of the present invention.

The CPU 2000 performs the control of the printing apparatus and data processing including processing described later in FIG. 12 using a program or data stored in a ROM 2001 and a RAM 2002. That is, in the ROM 2001, a program for controlling the units such as the image input part 2003, the image signal processing part 2004 and the head drive control circuit 2015 is stored. The RAM 2002 functions as a work area for processing a variety of data. The CPU 2000 controls the above parts via the main bus line 2005 according to the program stored in the ROM 2001.

Image data transmitted from a host device (for example, a host computer or a digital camera (not shown)) connected to the ink jet printing apparatus is input to the image input part 2003. The image signal processing part 2004 binarizes the image data input to the image input part 2003 under the control of the CPU 2000 and generates binary image data. The head drive control circuit 2015 controls the drive of an electro-thermal converting element provided for ejecting the inks from the ejection openings of the print head 100 under the control of the CPU 2000. In more detail, the head drive control circuit 2015 drives the electro-thermal converting element on the basis of the binary image data generated by the image signal processing part 2004. Accordingly, an image represented by the binary image data is formed on the print head. Although the electro-thermal converting element is used as an element for generating ejection energy herein, the generating element is not limited to the electro-thermal converting element. For example, a piezoelectric element may be used as the generating element.

The recovery system control circuit 2007 drives a recovery system motor 2008 according to a program for performing a recovery operation, which is stored in the ROM, and controls the recovery operation of the ink jet printing apparatus. More specifically, the recovery system motor 2008 drives the print head 100, and a cleaning blade 2009, a cap 2010 and a suction pump 2011 which are provided so as to face the print head, on the basis of a control signal from the recovery system control circuit 2007.

The print head 100 has a substrate on which the electro-thermal converting elements are provided. On this substrate, a diode sensor 2012 for measuring the temperature of the print head 100 and a heat-retention heater for adjusting the temperature of the print head are provided. The head temperature control circuit 2014 controls the operation of the heat-retention heater on the basis of the temperature of the head obtained by the diode sensor 2012 so as to adjust the temperature of the print head.

Hereinafter, embodiments for the reduction of color unevenness due to the reciprocating scanning operation in the ink jet printing apparatus according to the embodiment of the present invention shown in FIGS. 2 and 3 will be described.

First Embodiment

In a first embodiment of the present invention, when printing is performed such that different inks are ejected so as to overlap ink dots with each other, a satellite is separately formed with respect to the ink which is previously ejected so that the fixing area of the ink which is previously ejected is substantially equal to that of an ink which is subsequently ejected. According to the present embodiment, since the fixing area of ink which is previously ejected is substantially equal to that of the ink which is subsequently ejected in each of forward and backward scans, color differences which are wholly observed is averaged and thus a difference in color between areas in which printing is completed in respective forward and backward scans is reduced. Hereinafter, this will be described in detail.

Figure 4:
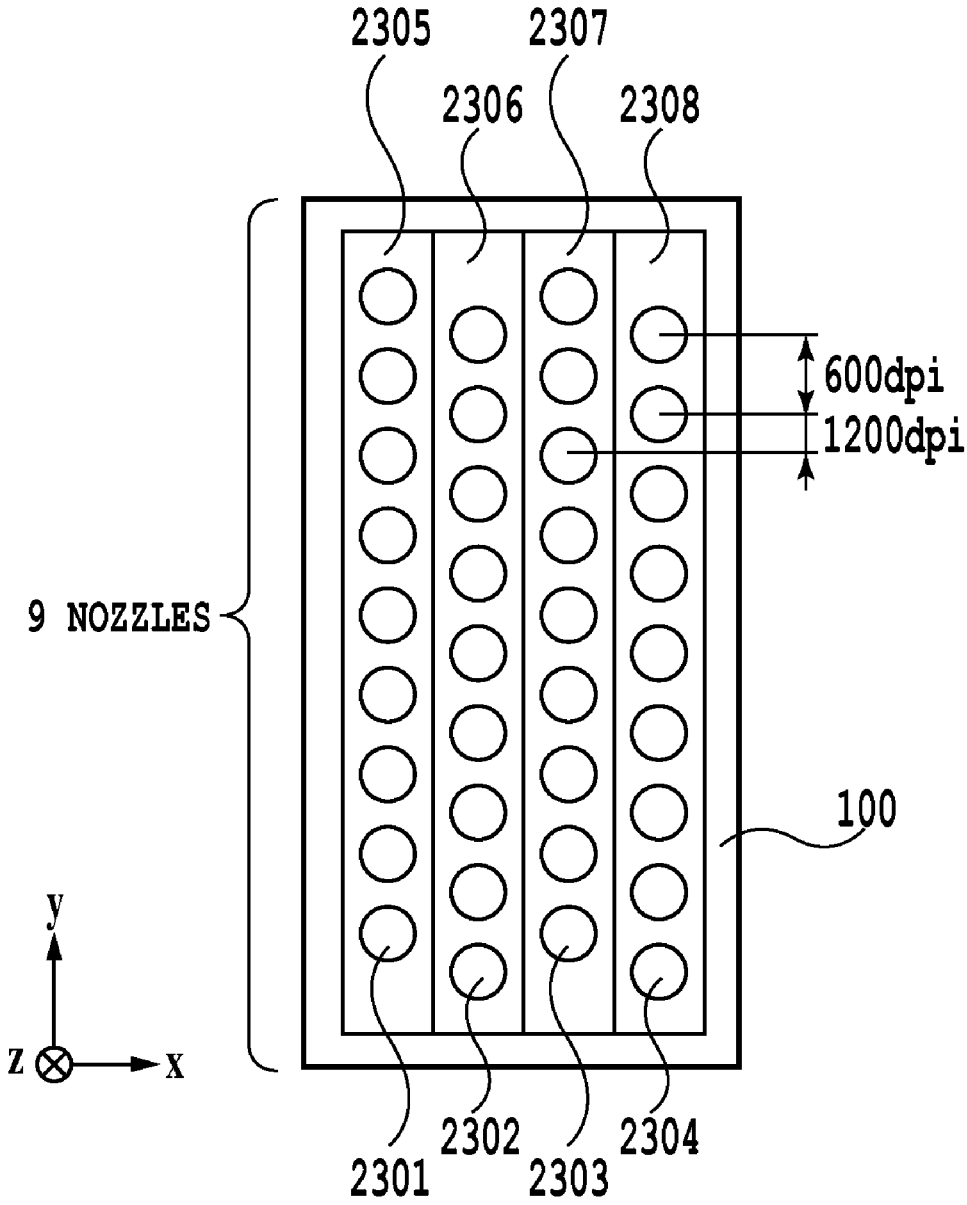
FIG. 4 is a view showing the configuration of a print head according to first and second embodiments of the present invention.

FIG. 4 is a view showing the arrangement of ejection opening arrays 2305 and 2306 of cyan (C) ink and ejection opening arrays 2307 and 2308 of magenta (M) ink in the print head 100. In this drawing, for simplification, the number of ejection openings (nozzles) is 9. Also, the ejection opening arrays of yellow (Y) and black (Bk) inks are not shown. In the ejection opening arrays of the respective colors, the interval between the ejection openings is 1/600 inches. Ink droplets of about 2 p1 per one droplet (the amount obtained by combining main droplet and the satellite) are ejected from the ejection openings at an ejection frequency of 15 KHz. The scanning speed of the print head 100 is about 25 inch/sec, so as to eject the ink droplets at that ejection frequency with an interval of 600 dpi in the main scanning direction. In the print head shown in FIG. 4, the ejection opening arrays 2305 and 2306 of the ink C and the ejection opening arrays 2307 and 2308 of the ink M are arranged in the main scanning direction so that the inks M and C overlap with each other in this order in the scanning of the forward (+X) direction.

Further, the ejection opening array 2305 and the ejection opening array 2306 of the ink C are arranged so as to be shifted from each other by an interval of 1200 dpi in the conveying direction (sub scanning direction) of the printing sheet denoted by Y and the respective ink ejection opening arrays eject the ink via a common liquid chamber (not shown). Similar to the ejection opening arrays of the ink C, the ejection opening array 2307 and the ejection opening array 2308 of the ink M are arranged so as to be shifted from each other by an interval of 1200 dpi in the Y direction and the respective ink ejection opening arrays eject the ink via a common liquid chamber.

Figure 5A:
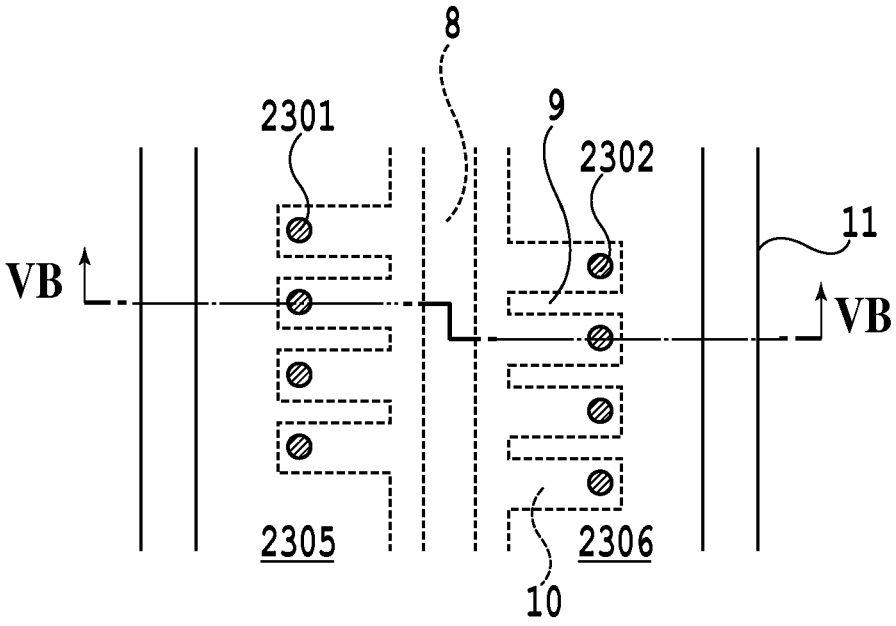
FIGS. 5A and 5B are views showing the configuration of the print head in which ejection manners of satellites are different from each other in forward and backward scans, according to the first and second embodiments of the present invention.
Figure 5B:
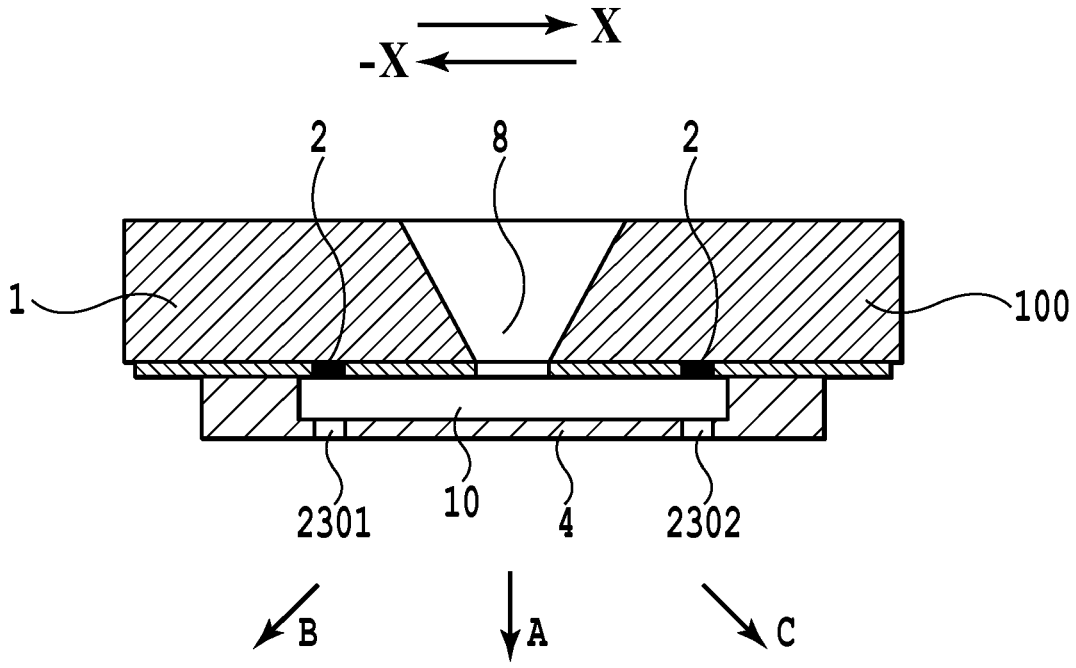

FIG. 5A is an enlarged view of the ejection opening arrays 2305 and 2306 of the ink C and FIG. 5B is a cross-sectional view taken along line VB-VB of FIG. 5A.

In FIGS. 5A and 5B, a reference numeral 1 denotes a substrate, a reference numeral 2 denotes a heater, and a reference numeral 4 denotes an orifice plate. Ink paths 10 are interposed between the substrate 1 and the orifice plate 4 and a partition wall 9 is provided between the plurality of ink paths 10. An ink supply port 8 is formed in the substrate 1. The heater 2 is provided on the substrate 1 so as to face the ejection openings 2301 and 2302 and a protective film is formed on the surface of the heater 2. The ink is supplied from the common liquid chamber (not shown) communicating with the ink paths 10 to the ejection openings 2301 and 2302 via the ink paths 10.

Now, the characteristics of the ejection direction of the main droplets and the satellites ejected from the ejection openings 2301 and 2302 will be described with reference to FIG. 5B.

First, when the heaters in the respective ejection openings are driven, the main droplets from the ejection openings 2301 and 2302 are ejected in a vertically downward direction denoted by A in the drawing. After the main droplets are ejected from the ejection openings, the ink is supplied (refilled) from the ink supply port 8 to the vicinity of the heater of the ejection openings, and thus the ink supply port 8 temporarily becomes an empty state. Then, the ink refilled in the ejection openings is slightly attracted toward the ink supply port 8. The surfaces of the inks at the ejection openings vibrate after the main droplets are ejected. Due to the influence of the refilled inks attracted toward the ink supply port 8, the vibration direction is changed from the vertically downward direction A to the direction in which the inks at the ejection openings are attracted, that is, the direction along a line connecting the ejection openings and the ink supply port. The satellites ejected after the main droplets are ejected in the state in which the surfaces of the inks vibrate, and thus the satellite from the ejection opening 2301 is ejected in a direction deflected from the vertically downward direction A toward the backward (−X) direction, which is denoted by B in the drawing. Also, the satellite from the ejection opening 2302 is ejected in a direction deflected from the vertically downward direction A toward the forward direction (X) direction, which is denoted by C of the drawing. As described above, while the main droplets are ejected from the ejection openings in the vertical downward direction A, the satellite is ejected in the direction B or C, instead of the vertical downward direction A.

The ejection opening arrays 2307 and 2308 of the ink M are equal to the ejection opening arrays of the ink C in the configuration of the print head and the characteristics of the ejection direction of the main droplets and the satellites.

Figure 6A:
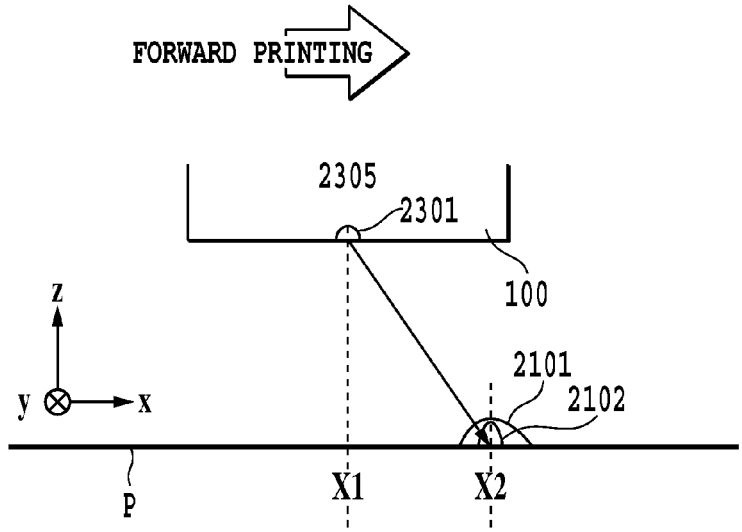
FIGS. 6A and 6B are views showing a dot group landing on a printing medium when eject is performed in a forward direction using a ejection opening 2301 of a ejection opening array 2305 according to first to third embodiments of the present invention.
Figure 6B:
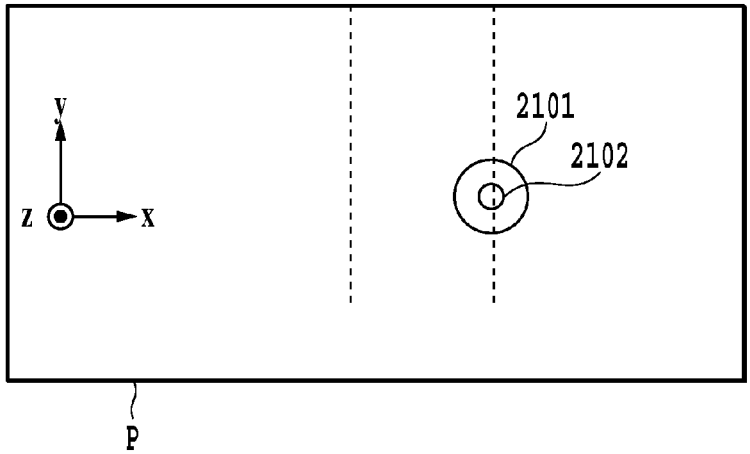

FIGS. 6A and 6B are views showing a relationship between the landing positions of the main droplet and the satellite when the ink is ejected from the ejection opening 2301 of the ejection opening array 2305 of cyan ink during the forward scan. In more detail, these drawings show a condition of a dot group of the main droplet and the satellite that land on the printing medium P when the ink is ejected from the ejection opening 2301 at the time when the ejection opening 2301 passes through a position X1 during the forward scan. When scanning of the print head 100 is performed at about 25 inch/sec, the main droplet 2101 and the satellite 2102 land so as to be shifted from the position X1 in the scanning direction toward the forward scan direction, due to the ejection speeds of the main droplet and the satellite. This is because the ejection speed of the satellite 2102 is lower than that of the main droplet 2101 and is further shifted than the main droplet 2101 toward the forward direction. However, in the ejection opening 2301 of the ejection opening array 2305 in the print head 100 of the present embodiment, since the satellite ejected from the ejection opening 2301 is ejected in the direction tilted toward the backward (−X) direction as described above, the main droplet 2101 and the satellite 2102 land and overlap with each other.

Figure 7A:
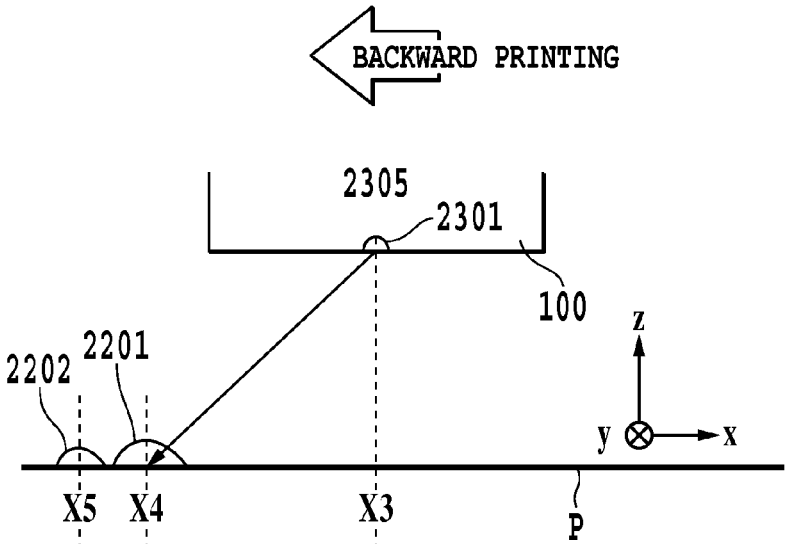
FIGS. 7A and 7B are views showing a dot group landing on a printing medium when eject is performed in a backward direction using the ejection opening 2301 of the ejection opening array 2305 according to the first to third embodiments of the present invention.
Figure 7B:
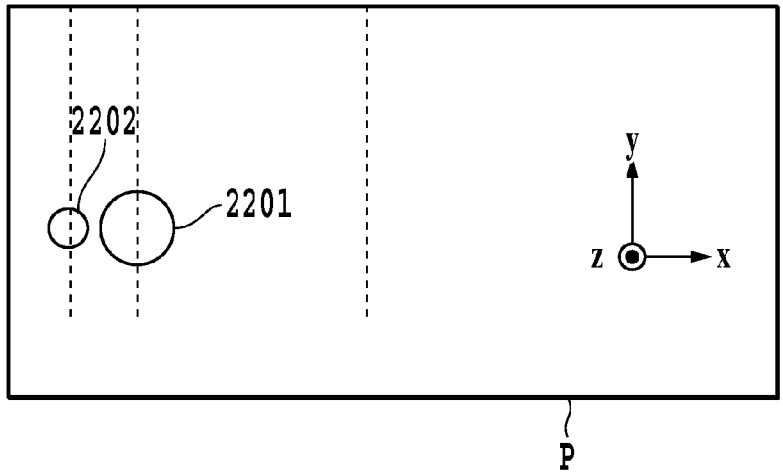

FIGS. 7A and 7B are views showing a relationship between the landing positions of the main droplet and the satellite when the ink is ejected from the ejection opening 2301 of the ejection opening array 2305 during the backward scan, similar to FIGS. 6A and 6B. In more detail, these drawings show a condition of a dot group of the main droplet and the satellite landing on the printing medium P when the ink is ejected from the ejection opening 2301 at the time when the ejection opening 2301 passes through a position X3 during the backward scan at the same speed as the forward direction.

In the backward scan, the main droplet 2201 and the satellite 2202 land so as to be shifted toward the backward direction, similar to the case of scanning in the forward direction. In this case, since the ejection speed of the satellite 2202 is lower than that of the main droplet 2201 and the satellite has an ejection characteristic in which the satellite from the ejection opening 2301 is ejected in a direction tilted toward the backward direction, the satellite 2202 lands so as to be further shifted toward the backward direction than the main droplet 2201. That is, in the backward scan, the landing positions of the main droplet and the satellite are shifted from each other.

As described above, in the ejection opening array 2305 of cyan, the main droplet and the satellite land so as to overlap with each other in the forward scan and the main droplet and the satellite land so as to be shifted from each other in the backward scan. Even with the ejection opening array 2307 of magenta, the relationship between the landing positions of the main droplet and the satellite in the forward and backward scans is equal to that shown in FIGS. 6 and 7.

Figure 8A:
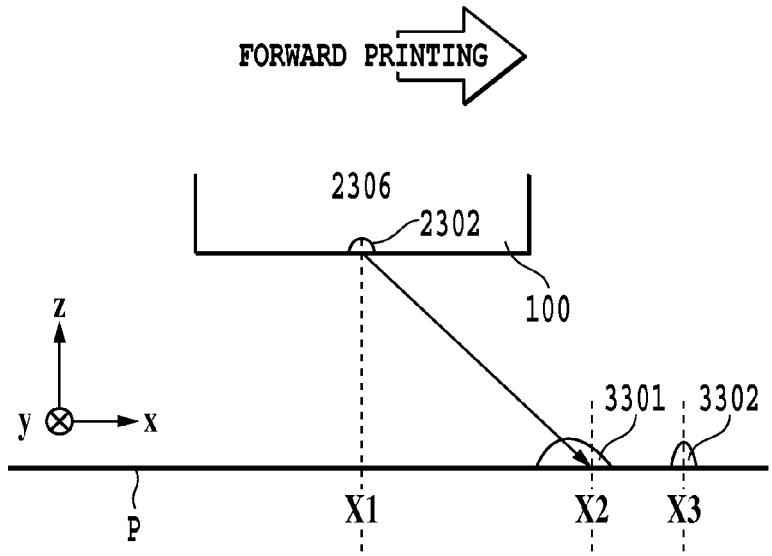
FIGS. 8A and 8B are views showing a dot group landing on a printing medium when eject is performed in a forward direction using a ejection opening 2302 of a ejection opening array 2306 according to first to third embodiments of the present invention.
Figure 8B:
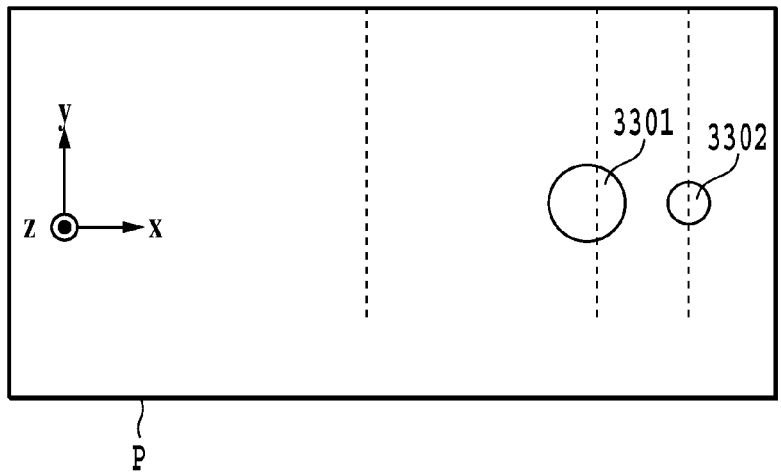

FIGS. 8A and 8B are views showing a relationship between the landing positions of the main droplet and the satellite when the ink is ejected from the ejection opening 2302 of the ejection opening array 2306 of cyan in the backward scan. As shown in these drawings, since the satellite from the ejection opening 2302 has a characteristic to be ejected in the direction tilted toward the forward direction, as described above, the satellite 3302 lands so as to be further shifted than the main droplet 3301 during the forward scan. That is, in the forward scan, the landing positions of the main droplet and the satellite are shifted from each other, similarly to the case of the backward scan (FIGS. 7A and 7B) of the ejection opening array 2305.

Figure 9A:
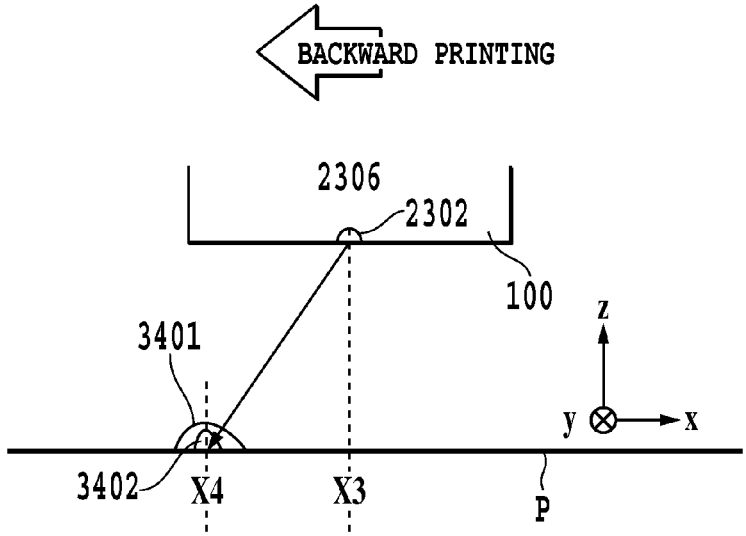
FIGS. 9A and 9B are views showing a dot group landing on a printing medium when eject is performed in a backward direction using the ejection opening 2302 of the ejection opening array 2306 according to the first to third embodiments of the present invention.
Figure 9B:
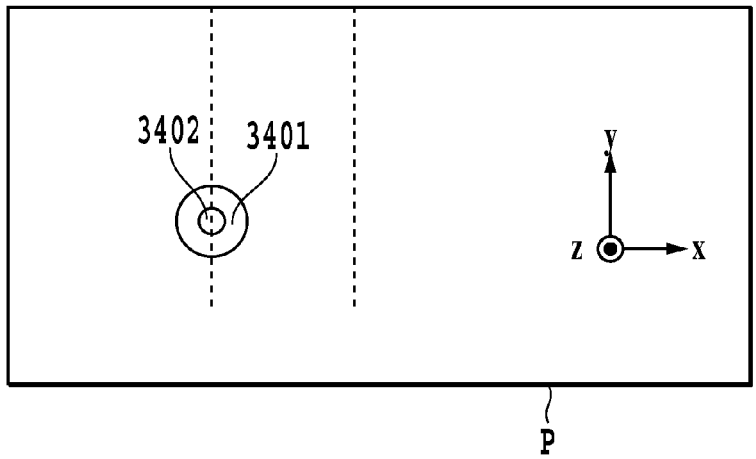

In contrast, FIGS. 9A and 9B are views showing a relationship between the landing positions of the main droplet and the satellite when the ink is ejected from the ejection opening 2302 of the ejection opening array 2306 during the backward scan. In the backward scan, the main droplet and the satellite land so as to overlap with each other, similarly to the forward scan (FIGS. 6A and 6B) of the ejection opening array 2304.

As described above, in the ejection opening array 2306 of cyan, the main droplet and the satellite land so as to be shifted from each other in the forward scan, but the main droplet and the satellite land so as to overlap with each other in the backward scan. Even with the ejection opening array 2308 of magenta, the relationship between the landing positions of the main droplet and the satellite in the forward and backward scans is the same as that shown in FIGS. 8 and 9.

Figure 10:
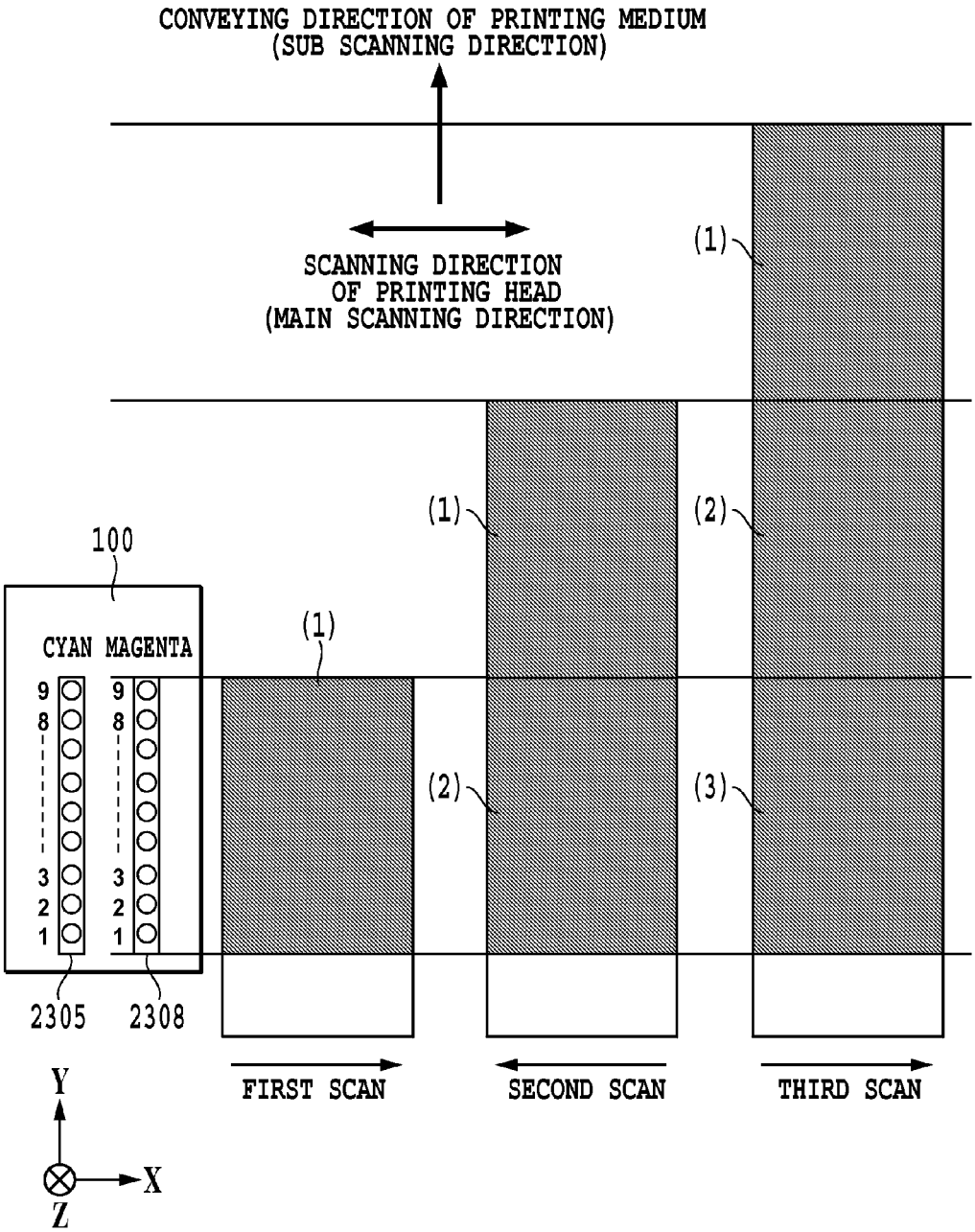
FIG. 10 is a view showing a printing operation according to the first embodiment of the present invention.
Figure 11:
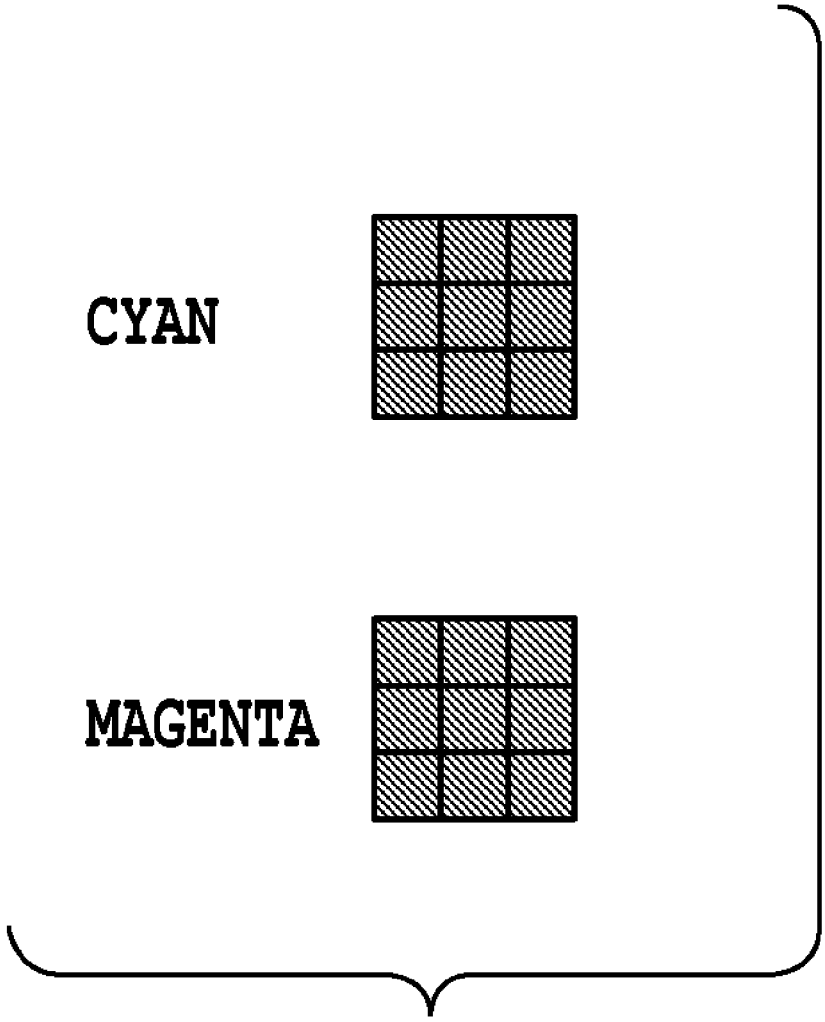
FIG. 11 is a view schematically showing a thinning pattern according to the first embodiment of the present invention.

FIG. 10 is a view illustrating a printing operation for completing an image by one-time scanning operation using the print head 100 shown in FIG. 4. FIG. 11 is a view showing mask patterns used for a mask process of printing data used for each scan in the printing operation. Further, FIG. 12 is a flowchart showing the printing operation according to the present embodiment.

As can be seen from the mask patterns shown in FIG. 11, all printing data is printed by one-time scanning operation with respect to cyan and magenta. That is, in FIG. 12, when the printing operation is started in a step 1601, paper is fed in a step 1602. Next, it is determined whether or not printing data is present in a step 1603 and, if the printing data is present, data to be printed is read for the forward direction in a step 1604. Then, in a step 1605, as shown in FIG. 10, the printing of an area (1) having a width corresponding to the ejection opening array is completed on the basis of the printing data of magenta and cyan in the forward scan as a first scan. Next, in a step 1606, the printing medium is conveyed by the amount corresponding to the length of the ejection opening array, that is, by 12 dots/600 dpi, in the sub scanning direction. After the conveyance, in a step 1607, the data to be printed is read for the backward direction. In a step 1608, the printing of an area (2) corresponding to the ejection opening arrays is completed on the basis of the printing data of magenta and cyan in the backward scan as a second scan shown in FIG. 10.

The same operation is repeated. That is, the printing medium is conveyed in the sub scanning direction in the step 1609, it is determined whether or not the printing data is present in the step 1603, and the above-described operation is performed if the printing data is present, and discharging the paper is performed in a step 1610 if the printing data is not present to complete the printing operation.

According to the first embodiment of the present invention, in the printing operation using the inks of cyan and magenta, only the ejection opening array 2305 of the ejection opening arrays 2305 and 2306 of the cyan ink is used and only the ejection opening array 2308 of the ejection opening array 2307 and 2308 of the magenta ink is used.

Figure 13A:
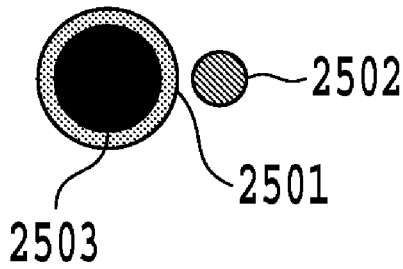
FIGS. 13A and 13B are views showing a dot landing on a printing medium according to the first embodiment of the present invention.
Figure 13B:
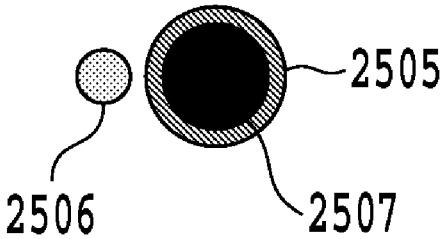

FIGS. 13A and 13B are views showing dots formed in the forward and backward scans respectively when the printing is performed with the inks of cyan and magenta using the ejection opening array 2305 and the ejection opening array 2308.

In the printing operation, the magenta ink and the cyan ink are ejected in this order in the forward scan. In this case, since the magenta ink is ejected from only the ejection opening array 2308, as shown in FIGS. 8A and 8B, the main droplet and the satellite land at different positions. Further, since the cyan ink which is subsequently ejected is ejected from only the ejection opening array 2305, as shown in FIGS. 6A and 6B, the main droplet and the satellite land so as to overlap with each other. That is, the magenta dots of the main droplet and the satellite are first formed at positions separated from each other. Then, the cyan dots of the main droplet and the satellite are formed so as to overlap with the dot of the main droplet of magenta. As a result, as shown in FIG. 13A, a blue main dot 2503 is formed by the overlap between cyan and magenta, and a cyan portion 2501 in the periphery of the main dot and a satellite dot 2502 of magenta are formed.

On the other hand, in the backward scan, the cyan ink and the magenta inks are ejected in this order, by the arrangement of the ejection opening arrays shown in FIG. 4. In this case, since the cyan ink is ejected from only the ejection opening array 2305, as shown in FIGS. 7A and 7B, the main droplet and the satellite land at different positions. Further, since the magenta ink which is subsequently ejected is ejected from only the ejection opening array 2308, as shown in FIGS. 9A and 9B, the main droplet and the satellite land so as to overlap with each other. That is, the cyan dots of the main droplet and the satellite are first formed at positions separated from each other. Then, the magenta dots of the main droplet and the satellite are formed so as to overlap with the dot of the main droplet of cyan. As a result, as shown in FIG. 13B, a blue main dot 2507 is formed by the overlap between cyan and magenta, and a magenta portion 2505 in the periphery of the main dot and a satellite dot 2506 of cyan are formed.

According to the present embodiment, the satellite of the ink which is previously ejected lands so as to be separated from the main dot and the satellite of the ink which is subsequently ejected lands in the main dot.

In a case where the printing is performed by sequentially ejecting the different color inks, the portion of the ink which is subsequently ejected is formed in the periphery of the main dot and thus the color of the ink which is subsequently ejected is strongly recognized. In contrast, according to the embodiment of the present invention, since the satellite of only the ink which is previously ejected is formed so as to be shifted from the main dot, it is possible to reduce the influence of the color of the ink which is subsequently ejected. As a result, a difference in color between the areas for which the printing is performed in the forward and backward scans respectively is reduced and the color unevenness of the printed image can be reduced.

The print head 100 of the present embodiment includes two columns of ejection opening arrays for ejecting the ink supplied from the common liquid chamber with respect to each of different inks. The printing is performed using the combination of ejection opening arrays so that the satellite of the ink which is previously ejected is ejected so as to be tilted toward the travel direction of the print head in both the forward and backward scans and the satellite of the ink which is subsequently ejected is ejected so as to be tilted toward the reverse direction of the travel direction. Accordingly, in the embodiment of the present invention, the satellite of the ink which is previously ejected lands so as to be separated from the main dot and the satellite of the ink which is subsequently ejected lands in the main dot, and thus color unevenness of the printed image can be reduced.

However, the configuration of the print head according to the present embodiment is not limited to the two columns of ejection opening arrays having the common liquid chamber with respect to the respective ink colors. More specifically, any print head may be included in the present invention as long as the print head having a configuration by which the satellite of the ink which is previously ejected lands so as to be separated from the main dot and the satellite of the ink which is subsequently ejected lands in the main dot. For example, the face of ejection opening array of the ink which is previously ejected may be formed so as to be sloped in the travel direction of the print head and the face of ejection opening array of the ink which is subsequently ejected may be formed so as to be sloped in the reverse direction of the travel direction. In this case, the main droplet and the satellite ejected from the ejection opening arrays have the sloped ejection direction characteristics, and due to the relationship between the ejection speeds of the main droplet and the satellite, the satellite of the ink which is previously ejected lands so as to be separated from the main dot and the satellite of the ink which is subsequently ejected lands in the main dot.

In the present embodiment, when the ejection of the print head is controlled so that the area of the portion (the color of the ink which is subsequently ejected) in the periphery of the main dot and the area of the satellite dot (the color of the ink which is previously ejected) become equal to each other, the color unevenness of the printed image can be best reduced. That is, when the total area of the main dot and the satellite dot is defined as the fixing area of ink which is previously ejected and the total area of the main dot and the peripheral region of the main dot is defined as the fixing area of ink which is subsequently ejected, it is preferable that the fixing area of ink which is previously ejected and the fixing area of the ink which is subsequently ejected are substantially equal to each other.

Second Embodiment

A second embodiment of the present invention relates to an example of applying the present invention to multi-pass printing. In the multi-pass printing in which the printing is completed an even number of times of scanning, the number of forward scans and the number of backward scans are equal. The colors generated by the reciprocating scan can be the same in areas in which printing is completed by the even number of times of scan. However, in the multi-pass printing in which printing is completed by an odd number of times of scan, the colors may be different from each other between areas in which the printing is completed, depending on whether the forward scan or the backward scan is performed one more time. In the present embodiment, the present invention is applied to the multi-pass printing of an odd number of times of scan. The apparatus and the print head are the same as those of the first embodiment.

Figure 14:
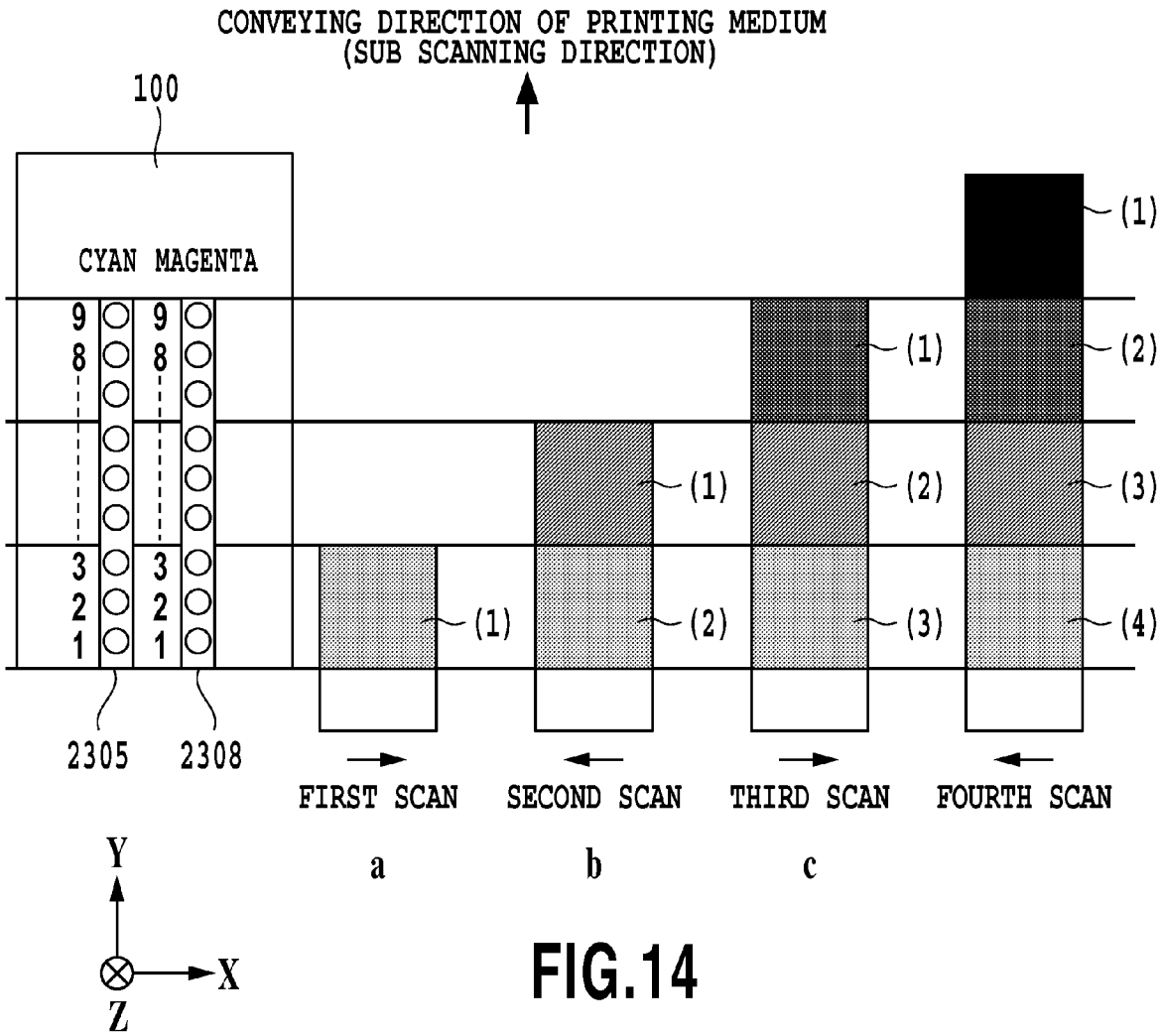
FIG. 14 is a view showing a printing operation according to the second embodiment of the present invention.
Figures 15A, 15B, 15C:
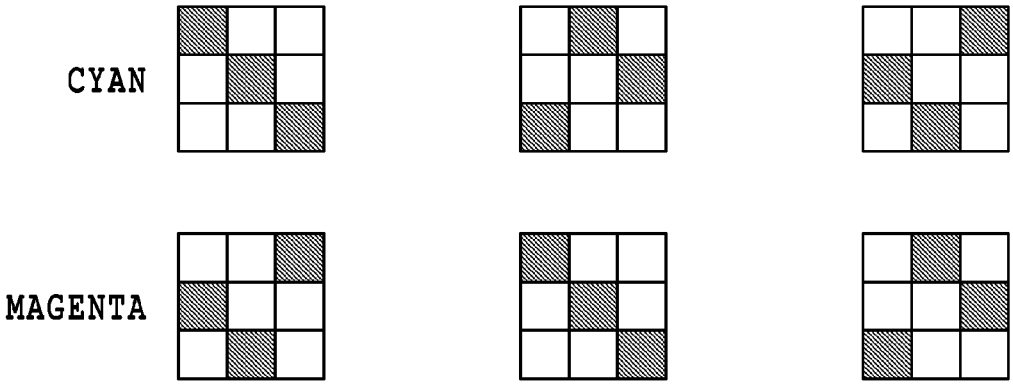
FIGS. 15A to 15C are views schematically showing a thinning pattern according to the second embodiment of the present invention.

FIG. 14 is a view illustrating a three-pass printing operation in which a print image of a predetermined area on a printing medium is completed by three times of scanning. FIGS. 15A to 15C are views showing masks used for the three-pass printing of the present embodiment. The patterns shown in FIGS. 15A, 15B and 15C are thinning patterns having a complementary relationship to each other.

As shown in FIG. 14, in a first scan, based on printing data generated using the mask shown in FIG. 15A, printing of the area (1) corresponding to three ejection openings of the ejection opening array is performed while the scanning of the respective ejection opening arrays of cyan and magenta is performed in the forward direction. Next, in a second scan, with respect to the area (1), the printing is performed in the backward scan based on the printing data generated using the mask shown in FIG. 15B. Then, in a third scan, with respect to the area (1), the printing is performed in the forward scan based on the printing data generated using the mask shown in FIG. 15C.

Figure 16A:
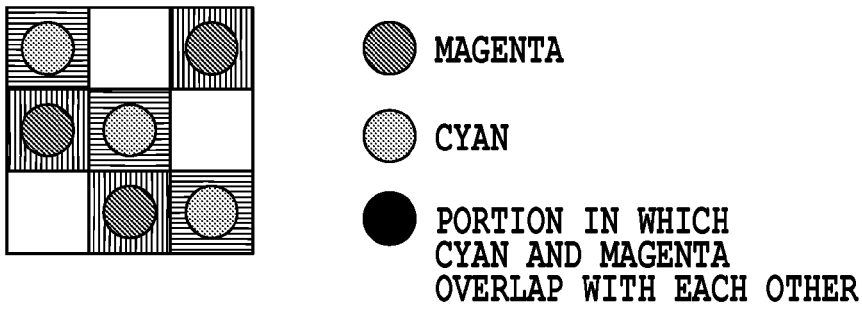
FIGS. 16A to 16C are views showing a printed image of an image area (1) according to the second embodiment of the present invention.
Figure 16B:
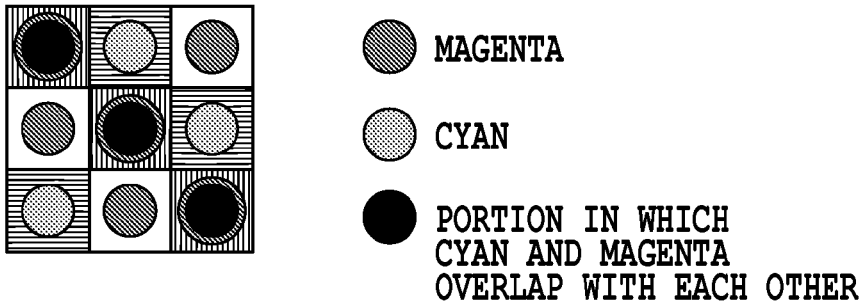
Figure 16C:
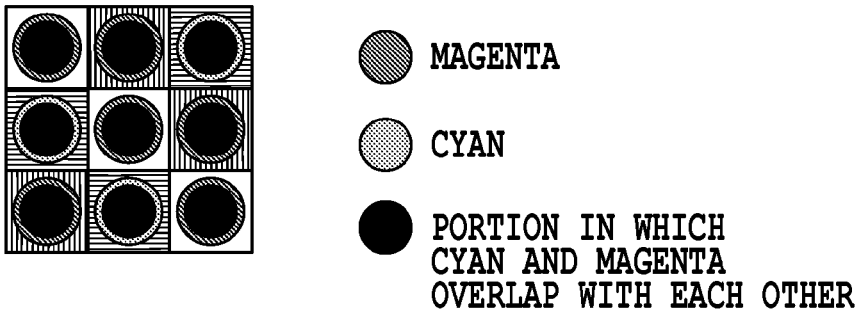

FIGS. 16A to 16C are views showing print results by the first to third scans for the area (1) shown in FIG. 14. FIGS.

Figure 18A:
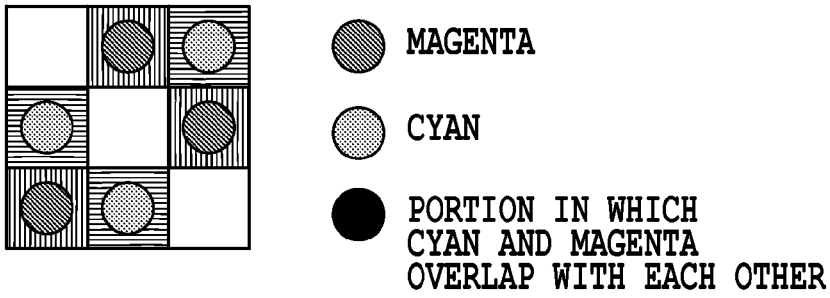
FIGS. 18A to 18C are views showing a printed image of an image area (3) according to the second embodiment of the present invention.
Figure 18B:
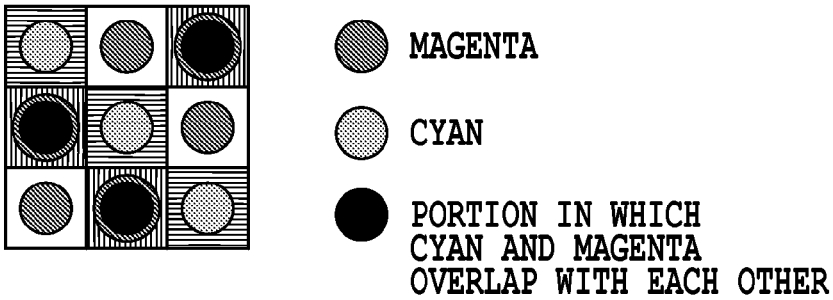
Figure 18C:
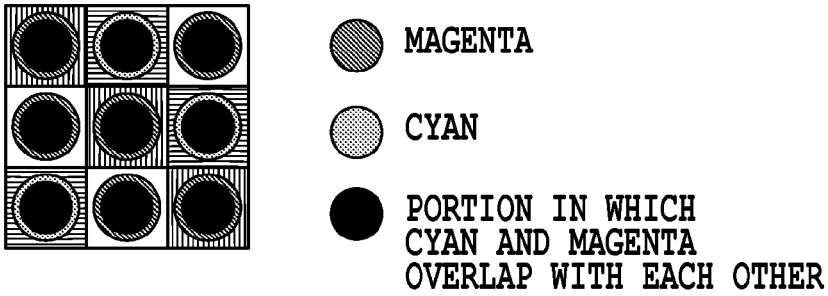

17A to 17C are views showing print results by the second to fourth scans for the area (2) shown in FIG. 14. FIGS. 18A to 18C are views showing the print results by the third to fifth scans for the area (3) shown in FIG. 14.

In the image of the area (1) by the first scan, the dots of the forward scan are formed as shown in FIG. 16A. Since the ejection opening arrays of magenta and cyan are used for printing by the exclusive masks as shown in FIGS. 15A to 15C, the dots are formed in separate pixels so that the magenta ink dot and the cyan ink dot do not overlap with each other in the same scan. The same is true in the following scans. In the drawing, the cyan pixels printed by this scan are denoted by a horizontal line and the magenta pixels are denoted by a vertical line.

Figure 17A:
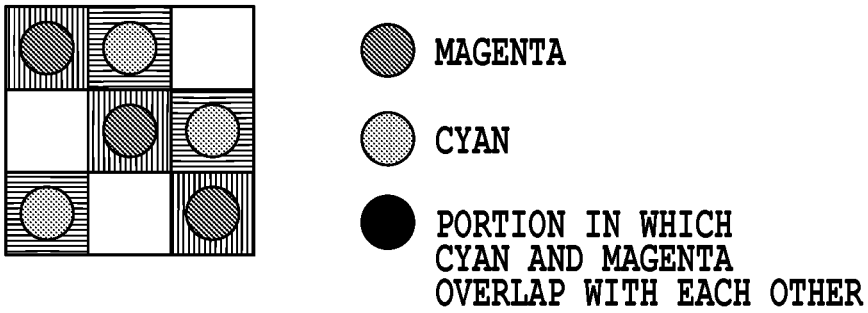
FIGS. 17A to 17C are views showing a printed image of an image area (2) according to the second embodiment of the present invention.

Next, in the second scan, in the printed image of the area (1), the dots of the backward scan are formed in addition to the dots of the forward scan as shown in FIG. 16B. The cyan pixels printed by this scan are denoted by the horizontal line and the magenta pixels printed by this scan are denoted by the vertical line. Also, with respect to the area (2), as shown in FIG. 17A, the dots of the backward scan are formed. The cyan pixels printed by this scan are denoted by the horizontal line and the magenta pixels printed by this scan are denoted by the vertical line.

Figure 17B:
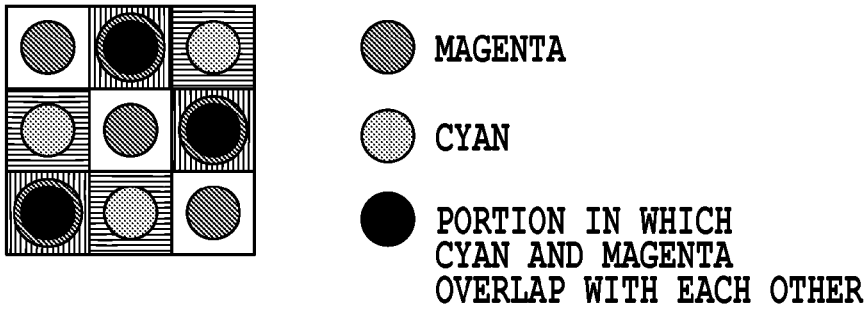

Further, in the third scan, in the printed image of the area (1), the dots of the forward scan are formed in addition to the dots of the forward scan and the dots of the backward scan, as shown in FIG. 16C. The printing for the area (1) is completed by this scan. The cyan pixels printed by this scan are denoted by the horizontal line and the magenta pixels printed by this scan are denoted by the vertical line. With respect to the printed image of the area (2), as shown in FIG. 17B, the dots of the forward scan are formed in addition to the dots of the backward scan. The cyan pixels printed by this scan are denoted by the horizontal line and the magenta pixels printed by this scan are denoted by the vertical line. Further, in the printed image of the area (3), as shown in FIG. 18A, the dots of the forward scan are formed. The cyan pixels printed by this scan are denoted by the horizontal line and the magenta pixels printed by this scan are denoted by the vertical line. Thereafter, by the same process, the printing of the areas (2), (3), (4), . . . is completed by three times of scans including the forward and backward scans.

In the above described three-pass printing, as can be seen from the mask patterns shown in FIGS. 15A to 15C, the magenta ink and the cyan ink do not overlap with each other in the same scan as in the first embodiment. However, the magenta ink and the cyan ink may overlap with each other in the different scans but in the same direction. For example, the magenta mask pattern shown in FIG. 15A and the cyan mask pattern shown in FIG. 15C are the same to each other. Accordingly, in this case, the magenta ink and the cyan ink overlap with each other in any of two different scans of the same direction, between which one scan is interposed. Then, the respective directions of the adjacent areas for which the printing is sequentially completed are opposite to each other. The present invention can provide the same effect as the first embodiment even when the printing is performed using two inks by the two scans of the same direction.

Figure 17C:
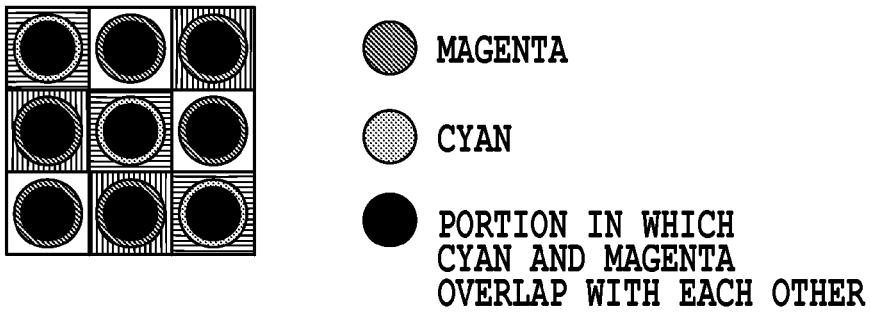

In the present embodiment, as described above, the pixels at which magenta and cyan overlap in this order by two different forward scans or the pixels at which cyan and magenta overlap in this order by two different backward scans are found at one-third (⅓) of all pixels in each area. For example, in the area (1) shown in FIG. 16C, the magenta and cyan dots overlapping in this order by two different forward scans are found at ⅓ of all the dots. Similarly, in the area (2) shown in FIG. 17C, the cyan and magenta dots overlapping in this order by two different backward scans are found at ⅓ of all the dots, and in the area (3) shown in FIG. 18C, similar to the area (1), the magenta and cyan dots overlapping in this order by two different forward scans are found at ⅓ of all the dots. Accordingly, like the first embodiment, the present embodiment can cause the satellite of the ink which is previously ejected to land separately form a main droplet, so that in these printing areas, the difference in color can be reduced at ⅓ of all the pixels.

Although, in the present embodiment, the image is completed by three times of printing scans, the present invention is not limited this configuration. For example, the same effect can be obtained even with respect to the multi-pass printing in which the image is completed by repeating the reciprocating operation of the scan direction an odd number of times greater than three times. In the present embodiment, since the color unevenness of the image is not generated with respect to the multi-pass printing in which the image is completed by repeating the reciprocating operation of the scan direction an even number of times, the printing is performed using four ejection opening arrays including the ejection opening arrays 2305 and 2306 of the cyan ink and the ejection opening arrays 2307 and 2308 of the magenta ink.

Third Embodiment

The above described first and the second embodiments are explained for a case where printing is performed so that the inks of two colors overlap with each other. In contrast, a third embodiment of the present invention will be explained for a case where printing is performed so that the inks of three colors overlap with one another in one time of scanning.

Figure 19:
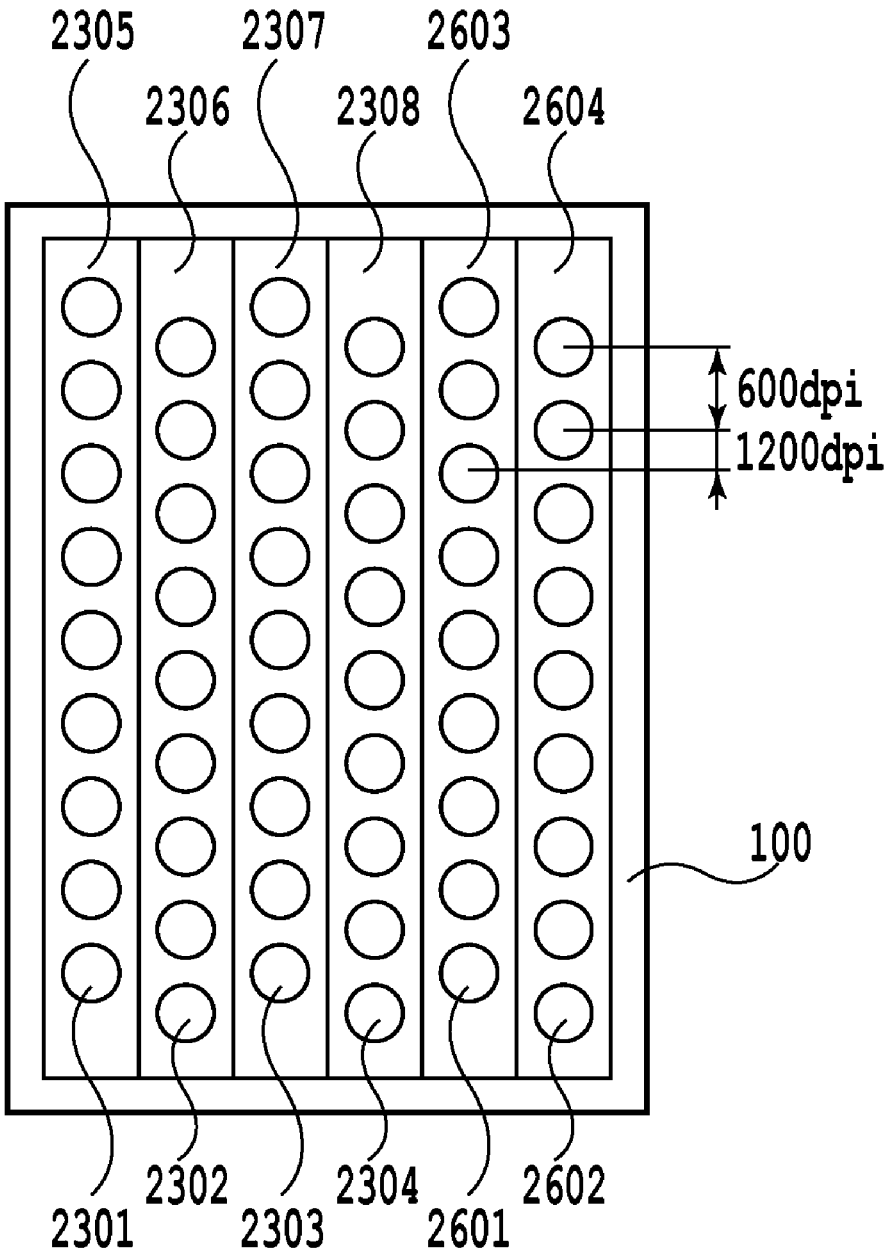
FIG. 19 is a view showing the configuration of a print head according to a third embodiment of the present invention.

FIG. 19 is a view showing an example of the arrangement of the ejection opening arrays three types of inks in the print head according to the present embodiment. In more detail, the arrangement of the ejection opening arrays 2603 and 2604 of yellow ink are shown in addition to the ejection opening arrays 2305 and 2306 of the cyan ink and the ejection opening arrays 2307 and 2308 of the magenta ink shown in the first and second embodiments.

The ejection opening arrays 2603 and 2604 of the yellow ink have the same print head configuration as the respective ejection opening arrays of the cyan and magenta inks, and ejection direction characteristics of the main droplet and the satellite are the same as that of the respective ejection opening arrays of the cyan.

Among the ejection opening arrays for ejecting the inks of three types, with respect to the ejection opening arrays of the two types of ink, like the first and second embodiments, printing can be controlled so that the fixing area of the ink which is previously ejected and the fixing area of the ink which is subsequently ejected are substantially same. However, with respect to the remaining ejection opening arrays of one type of ink, the printing cannot be controlled so that the fixing area is conformed to that of the ejection opening arrays of the two types of inks. Thus, the influence of the color of the one type of ink may be appeared in the printed image.

Accordingly, in the present embodiment, with respect to the cyan and magenta ink among the three inks of cyan, magenta and yellow, like the first and second embodiments, the fixing area of the ink which is previously ejected and the fixing area of the ink which is subsequently ejected are substantially the same. More specifically, since the yellow ink which has lower visibility than that of cyan and magenta inks, has relatively low influence of the color in the printed image although the fixing area thereof is different from that of the cyan or magenta ink, the fixing areas of the cyan and magenta inks are made substantially same.

As shown in FIG. 19, the print head 100 of the present embodiment further includes the ejection opening arrays 2603 and 2604 of the yellow ink in addition to the ejection opening arrays 2305 and 2306 of the cyan ink and the ejection opening arrays 2307 and 2308 of the magenta ink included in the print head shown in FIG. 4. In the ejection opening arrays 2603 and 2604 of yellow, ejection openings 2601 and 2602 of respective ejection opening arrays are arranged with an interval of 1/600 inches, and the ejection opening array 2603 and the ejection opening array 2604 are shifted from each other by 1/1200 inches.

In the present embodiment, in using the print head shown in FIG. 19, only the ejection opening array 2305 of the ejection opening arrays 2305 and 2306 of the cyan ink is used and only the ejection opening array 2308 of the ejection opening arrays 2307 and 2308 of the magenta ink is used. With respect to the ejection openings of the yellow ink, only one ejection opening array of the ejection opening arrays 2603 and 2604 may be used, or the printing data of yellow may be divided into the ejection opening arrays 2603 and 2604 and thus both the ejection opening arrays may be used.

As described above, according to the present embodiment, in a case where the printing is performed using the print head having two ejection opening arrays with respect to cyan, magenta and yellow, the color unevenness having a band shape due to a difference in the ejection order of the inks of respective colors by the reciprocating scanning operation can be reduced by controlling the printing of the first embodiment with respect to the ejection opening arrays of cyan and magenta.

Although, in the present embodiment, the ejection opening arrays have the same ejection amount of 2p1, the other ejection amounts may be used instead of 2p1. Even when the ejection opening arrays have different ejection amounts, the same effect can be obtained. In the present embodiment, as described in the second embodiment, the same effect can be obtained even in the configuration in which the image is completed by repeating the scanning operations an odd number of times greater than three times.

Fourth Embodiment

In the above-described first to third embodiments, the fixing area of the ink which is previously ejected and the fixing area of the ink which is subsequently ejected are substantially the same so that the area of the portion in which the color is different due to the difference in the overlapping order of the ink dots in the reciprocating scanning operation is reduced. In contrast, in a fourth embodiment of the present invention, the ejection amount of the ink which is subsequently ejected is reduced so that the ejection amount of the ink which is previously ejected is larger than that of the ink which is subsequently ejected. Thus, the area of the portion in which the color is different is reduced or substantially removed.

Figures 1A, 1B, 1C:
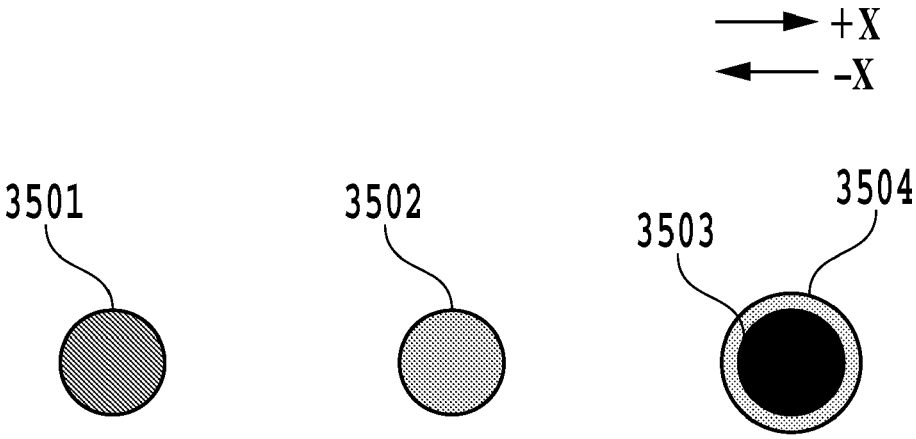
FIGS. 1A to 1C are views showing illustrating a phenomenon that the diameter of a dot which lands later is increased, in order to explain the problem to be solved by the present invention.

For example, as shown in FIG. 1C, in a case where the magenta ink is previously ejected and the cyan ink is then ejected, an edge portion 3504 of the cyan dot is generated in the periphery of the main dot. Due to this portion, the difference in color of the printing area is generated in the scanning direction and thus the color unevenness of the whole image occurs.

In the present embodiment, in the examples of FIGS. 1A to 1C, in the forward (+X) scan, the ejection amount of the cyan ink which is subsequently ejected is reduced. In contrast, in the backward (−X) scan, the ejection amount of the magenta ink which is subsequently ejected is reduced. By this operation, even if a region of the ink which is subsequently ejected is formed in the periphery of the main dot, the area of the region can be reduced. That is, the edge portion having a different color is reduced and thus the color unevenness generated in the printed image can be reduced.

Instead of the control of the ejection amount of the ink which is subsequently ejected, the ejection amount of the ink which is previously ejected may be controlled to be increased. As the result of overlapping the dots of two types, the ejection amount is decided such that the portion in which the color or the concentration is different is further reduced by the overlap. For example, in a case where the dots of the main droplet and the satellite are formed like the above-described embodiments, the ejection amount can be determined in consideration of the area of the satellite.

The control of the ejection amount can be performed by controlling a pulse waveform such as the pulse width of the pulse in a method of applying a voltage pulse to the electrothermal converting element used in the above-described embodiments so as to generate thermal energy and ejecting the ink. In a piezoelectric print head, the ejection amount can be changed by controlling the voltage applied to the piezoelectric element.

Other Embodiments

Although the cyan ink and the magenta ink are used as the inks of different colors of the above-described embodiments, the present invention is not limited thereto. The inks of different colors include inks in which the concentrations of a coloring materials such as pigments or dyes are different, in the present specification. It is apparent from the above description that the present invention is applied to the case where the printing is performed by the reciprocating scanning operation using the inks in which the concentrations of the coloring materials are different.

In a case where the printing is performed by overlapping different inks, a phenomenon that the region of the ink which is subsequently ejected is formed in the periphery of the main dot is particularly generated when the printing is performed on coated paper using the dye ink. Accordingly, the present invention in which the fixing area of the ink which is first ejected and the fixing area of the ink which is subsequently ejected are substantially equal is efficient in a case where the coated paper and the dye ink are used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-261264, filed Oct. 4, 2007, which is hereby incorporated by reference herein in its entirety.

What is claimed is:

1. An ink jet printing apparatus that uses a print head having a first ejection opening array for ejecting a first color ink and a second ejection opening array for ejecting a second color ink, and ejects the first and second color inks in this order during a scanning of the print head in a first direction and ejects the second and first color inks in this order during a scanning of the print head in a second direction to perform printing on a printing medium, wherein in the scanning in the first direction, a fixing area of the first color ink is larger than a fixing area of the second color ink, and in the scanning in the second direction, a fixing area of the second color ink is larger than a fixing area of the first color ink.

2. An ink jet printing apparatus as claimed in claim 1, wherein a main droplet and a satellite of the first color ink ejected from the first ejection opening array during the scanning of the print head in the first direction form separate dots from each other on the printing medium, a main droplet and a satellite of the second color ink ejected from the second ejection opening array during the scanning of the print head in the first direction form a same dot on the printing medium, a main droplet and a satellite of the first color ink ejected from the first ejection opening array during the scanning of the print head in the second direction form a same dot on the printing medium, and a main droplet and a satellite of the second color ink ejected from the second ejection opening array during the scanning of the print head in the second direction form separate dots from each other on the printing medium.

3. An ink jet printing apparatus as claimed in claim 2, wherein the satellite of the first color ink ejected from the first ejection opening array is ejected in a direction tilted toward the first direction, and the satellite of the second color ink ejected from the second ejection opening array is ejected in a direction tilted toward the second direction.

4. An ink jet printing apparatus as claimed in claim 1, that performs an odd number of times of the scanning to a predetermined area of the printing medium so as to complete printing of an image on the predetermined area.

5. An ink jet printing apparatus as claimed in claim 1, wherein the printing medium is a coated paper.

6. An ink jet printing apparatus that performs scanning of a print head, in which first and second ejection opening arrays for ejecting a first color ink and third and fourth ejection opening arrays for ejecting a second color ink are arranged in a predetermined direction in this order, to a predetermined area of a printing medium a plurality of times so as to perform printing, wherein when performing printing by an odd number of times of the scanning to the predetermined area, only the first and fourth ejection opening arrays of the first, second, third and fourth opening arrays are used for performing printing, and when performing printing by an even number of times of the scanning to the predetermined area, the first, second, third and fourth opening arrays are used for performing printing.

7. An ink jet printing apparatus as claimed in claim 6, wherein the first and second ejection opening arrays are ejection opening arrays that eject the first ink supplied through a common chamber, and the third and fourth ejection opening arrays are ejection opening arrays that eject the second ink supplied through a common chamber.

8. An ink jet printing apparatus as claimed in claim 6, wherein the printing medium is a coated paper.

9. An ink jet printing apparatus that uses a print head having a first ejection opening array for ejecting a first color ink and a second ejection opening array for ejecting a second color ink, and ejects the first and second color inks in this order during a scanning of the print head in a first direction and ejects the second and first color inks in this order during a scanning of the print head in a second direction to perform printing on a printing medium, wherein in the scanning in the first direction, an ejection amount of the first color ink is larger than an ejection amount of the second color ink, and in the scanning in the second direction, an ejection amount of the second color ink is larger than an ejection amount of the first color ink.

10. An ink jet printing method of using a print head having a first ejection opening array for ejecting a first color ink and a second ejection opening array for ejecting a second color ink, and ejecting the first and second color inks in this order during a scanning of the print head in a first direction and ejecting the second and first color inks in this order during a scanning of the print head in a second direction to perform printing on a printing medium, wherein in the scanning in the first direction, a fixing area of the first color ink is larger than a fixing area of the second color ink, and in the scanning in the second direction, a fixing area of the second color ink is larger than a fixing area of the first color ink.

11. An ink jet printing method of performing scanning of a print head, in which first and second ejection opening arrays for ejecting a first color ink and third and fourth ejection opening arrays for ejecting a second color ink are arranged in a predetermined direction in this order, to a predetermined area of a printing medium a plurality of times so as to perform printing, wherein when performing printing by an odd number of times of the scanning to the predetermined area, only the first and fourth ejection opening arrays of the first, second, third and fourth opening arrays are used for performing printing, and when performing printing by an even number of times of the scanning to the predetermined area, the first, second, third and fourth opening arrays are used for performing printing.

* * * * *